US006022097A

United States Patent [19]

Minemoto et al.

[11] Patent Number: 6,022,097

[45] Date of Patent: Feb. 8, 2000

[54] INK-JET PRINTER TO USE INK CONTAINING PIGMENT PARTICLES

[75] Inventors: Hitoshi Minemoto; Yoshihiro Hagiwara; Ryousuke Uematsu; Junichi Suetsugu; Kazuo Shima, all of Tokyo, Japan

[73] Assignee: NEC Corporation, Tokyo, Japan

[21] Appl. No.: 08/702,178

[22] Filed: Aug. 23, 1996

[30] Foreign Application Priority Data

Aug. 23, 1995 [JP] Japan ..... 7-214771
Aug. 23, 1995 [JP] Japan ..... 7-214772

[51] Int. Cl.[7] ..... B41J 2/035

[52] U.S. Cl. ..... 347/55; 347/10; 347/11; 347/14; 347/19

[58] Field of Search ..... 347/9, 10, 11, 347/14, 19, 55

[56] References Cited

U.S. PATENT DOCUMENTS 5,204,695 4/1993 Tokunaga et al. ..... 347/11
5,272,490 12/1993 Murano et al. ..... 347/237

FOREIGN PATENT DOCUMENTS

0223379A1 5/1987 European Pat. Off. .
1-141056 6/1989 Japan ..... 347/55
WO9311866 6/1993 WIPO .

OTHER PUBLICATIONS

Patent Abstracts of Japan, vol. 014, No. 416 (M–1021), Sep. 7, 1990 corresponding to JP 02 160557 A (Minolta Camera Co. Ltd), Jun. 20, 1990.

Patent Abstracts of Japan, vol. 005, No. 093 (M–074), Jun. 17, 1981 corresponding to JP 56 040563 A (Ricoh Co Ltd) dated Apr. 16, 1981.

*Primary Examiner*—John Barlow
*Assistant Examiner*—Christina Annick
*Attorney, Agent, or Firm*—Sughrue, Mion, Zinn, Macpeak & Seas, PLLC

[57] ABSTRACT

The invention relates to an ink-jet printer which uses an ink containing fine solid particles of a pigment suspended in a carrier liquid. The print head of the printer has an ink ejection orifice at one end of an ink chamber, and the ink chamber is provided with a first electrode to which a first DC voltage is applied for concentrating the pigment particles in the vicinity of the orifice by electrophoresis and a second electrode to which a second DC voltage in pulse form is applied for ejecting an agglomeration of the pigment particles together with a small amount of carrier liquid from the orifice. In the printer, the length of waiting time, which elapses from the decay of a pulse of the second voltage, is checked. When the waiting time is relatively long, the polarity of the first voltage is inverted to prevent excessive concentration of pigment particles in or in the vicinity of the orifice, and/or the second voltage is modified to promote movement of pigment particles in the vicinity of the second electrode toward the tip of the second electrode.

11 Claims, 8 Drawing Sheets

E: EJECTION OF AN AGGLOMERATION OF PIGMENT PARTICLES

E : EJECTION OF AN AGGLOMERATION OF PIGMENT PARTICLES

E : EJECTION OF AN AGGLOMERATION OF PIGMENT PARTICLES

INK-JET PRINTER TO USE INK CONTAINING PIGMENT PARTICLES

BACKGROUND OF THE INVENTION

This invention relates to an ink-jet printer which uses an ink containing fine solid particles of a pigment suspended in a carrier liquid. More particularly, the ink-jet printer is of the type utilizing electrophoresis of the pigment particles in the ink in an ink chamber of the print head for concentrating the particles in the vicinity of an ink ejection orifice provided at an end of the ink chamber.

In known ink-jet printers of the above-mentioned type, the ink chamber in the print head is provided with a first electrode to which a steady DC voltage is applied to produce an electric field in the ink chamber thereby to induce electrophoresis of the electrically charged pigment particles in the ink toward the ink ejection orifice. As the pigment particles migrate toward the orifice at a definite rate, the particles concentrate in the vicinity of the orifice. A second electrode is disposed in the ink chamber close to the orifice. After concentrating the pigment particles in the vicinity of the orifice, a DC voltage in pulse form is applied to the second electrode to cause ejection of an agglomeration of the pigment particles together with a small amount of the carrier liquid from the orifice toward a recording surface. On the recording surface the agglomeration of pigment particles forms a single dot. By repeating this process while the ink chamber is replenished with the ink, an image is printed on the recording surface. When the pulse duration of the voltage pulse is relatively long, each pulse causes ejection of a few or several agglomerations of pigment particles one after another at nearly constant time intervals, and on the recording surface these agglomerations form a single dot of a relatively large size.

In the operation of the ink-jet printer described above, concentration of the pigment particles in the vicinity of the ink ejection orifice reaches an excessive extent if the application of a voltage pulse to the second electrode is interrupted for a relatively long period of time. Then, it is likely that the orifice is clogged with the pigment particles. Even though the orifice is not clogged, the ejection of an agglomeration of pigment particles will become unstable. These phenomena lead to degradation of the printing quality.

When the time interval between two pulses of the voltage applied to the second electrode is relatively long, there arises another problem that the ejection of an agglomeration of pigment particles by the later pulse is liable to be delayed or missed. This is because the pigment particles tend to move away from the tip part of the second electrode before the application of the later pulse of voltage to the second electrode.

SUMMARY OF THE INVENTION

It is an object of the present invention to provide an improved ink-jet printer of the above-described type to solve the problems explained above.

An ink-jet printer according to the invention uses an ink containing fine solid particles of a coloring material suspended in a carrier liquid, and the printer comprises a print head comprising (i) an ink chamber to be filled with the ink, (ii) an ink ejection orifice located at one end of the ink chamber, (iii) a first electrode provided to the ink chamber to produce an electric field in the ink chamber such that by electrophoresis induced by the electric field the particles in the ink in the ink chamber are concentrated in the vicinity of the orifice, and (iv) a second electrode which is disposed in the ink chamber and has a tip part positioned close to the orifice to produce another electric field to eject at least one agglomeration of the particles of coloring material together with a relatively small amount of the carrier liquid from the orifice, and a control part which comprises first means for applying a first DC voltage to the first electrode and periodically applying a second DC voltage in the form of pulse to the second electrode based on externally supplied print information, second means for checking the length of waiting time elapsed from the decay of a pulse of the second DC voltage and third means for modifying at least one of the first DC voltage and the second DC voltage when the waiting time is relatively long.

To prevent excessive or unwanted concentration of the particles of the coloring material (pigment particles) in the vicinity of the ink ejection orifice, the first DC voltage applied to the first electrode is modified so as to prevent or suppress the migration of the particles toward the orifice when the checked waiting time is not shorter than a first predetermined length of time. In a preferred embodiment of the invention, the polarity of the first DC voltage is inverted to cause the pigment particles to migrate in the direction opposite to the orifice. The inverted polarity of the first DC voltage is returned to the original polarity if the application of a next pulse of the second DC voltage to the second electrode is demanded before the lapse of a second predetermined length of time from the inversion of the polarity. Otherwise, the application of the first DC voltage to the first electrode may be interrupted after the lapse of the second predetermined length of time so that the print head can assume a stand-by state without unwanted concentration of pigment particles in the vicinity of the orifice.

For the purpose of concentrating the pigment particles on the tip part of the second electrode in preparation for the ejection of an agglomeration of pigment particles from the orifice, the second DC voltage is modified when waiting time between a pulse of the second DC voltage and a next pulse is not shorter than a predetermined length of time. A preferred manner of modifying the second DC voltage is applying a pilot DC voltage to the second electrode just before applying the next pulse of the second DC voltage to the same electrode. The pilot voltage is a voltage that is effective for moving the pigment particles exisiting in the vicinity of the orifice toward the tip of the second electrode but is ineffective for ejecting the particles from the orifice. An example of the pilot voltage is a pulse train consisting of a few or several rectangular pulses each of which is shorter in pulse duration than each pulse of the second DC voltage. Another manner of modifying the second DC voltage is augmenting the amplitude of the above-mentioned next pulse of the second DC voltage.

With an ink-jet printer according to the invention, stable and quick ejection of an agglomeration of pigment particles can be accomplished by each pulse of the second DC voltage applied to the second electrode even though a relatively long period of time has elapsed from the application of the preceding pulse of the second voltage.

DESCRIPTION OF THE PREFERRED EMBODIMENTS

Figure 1:
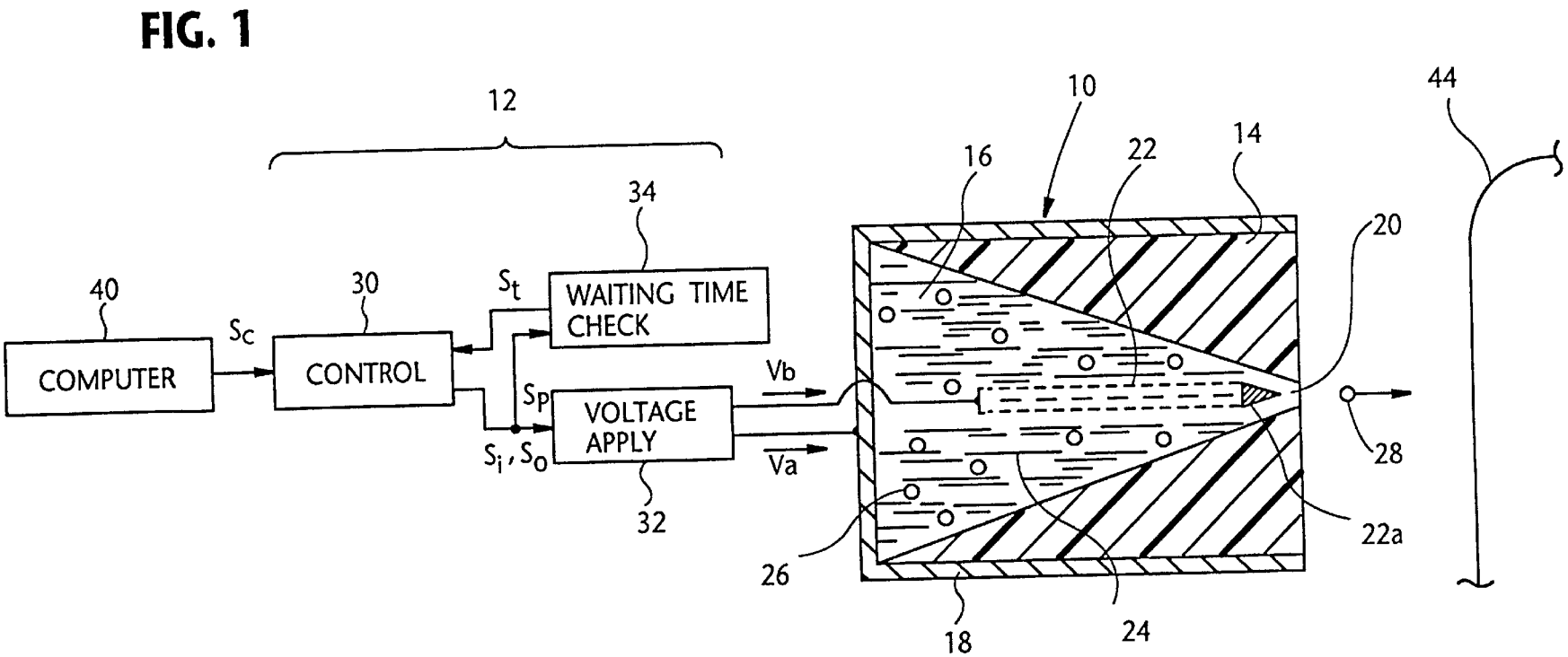
FIG. 1 is a schematic illustration of the principal parts of an ink-jet printer embodying the invention.

FIG. 1 shows the principal parts of an ink-jet printer as an embodiment of the invention. The printer has a print head 10 and a control part 12 which includes a control circuit 30, a voltage applying circuit 32 and a waiting time checking circuit 34. In practice, the print head 10 has a plurality of ink ejection orifices. However, for simplicity, FIG. 1 shows only one ink ejection orifice 20.

In the print head 10, an ink chamber 16 for the ink ejection orifice 20 is formed in a dielectric body 14 such as a synthetic resin body. The ink chamber 16 has a conical shape, and the orifice 20 is at the apex of the conical chamber 16. That is, the cross-sectional area of the ink chamber 16 gradually decreases toward the orifice 20. To produce an electric field in the ink chamber 16, an electrode 18 in the shape of a hollow cylinder closed at one end is fitted around the body 14 such that the closed end of the electrode 18 is located at the base end of the conical ink chamber 16. The electrode 18 and the body 14 have the sane length so that the orifice 20 is in the center of the open end of the electrode 18. In the ink chamber 15 there is another electrode 22 having a tip part 22*a* which in the principal part of the electrode 22 and is positioned close to the orifice 20 and pointed toward the orifice 20. It is optional to modify the arrangement of the electrode 22 such that the tip of this electrode slightly protrudes from the orifice 20

The ink chamber 16 is filled with an ink 24, which contains fine solid particles 26 of a pigment (coloring material) suspended in a carrier liquid. The pigment particles 26 in the ink 24 are inherently electrically charged. When an appropriate electric field exists in the ink chamber 16, the electric field causes electrophoresis of the particles 26 such that the particles 26 migrate toward the orifice 20 and concentrate in the vicinity of the orifice 20. For this purpose, a DC voltage $V_a$ (will be called electrophoresis voltage) is applied from the voltage applying circuit 32 to the electrode 18. When an appropriate DC voltage $V_b$ (will be called ejection voltage) is applied to the electrode 22 after concentrating the pigment particles 26 in the vicinity of the orifice 20, at least one agglomeration 28 of pigment particles 26 together with a small amount of the carrier liquid is ejected from the orifice 20 toward a recording material 44 such as a paper sheet.

The control circuit 30 of the printer supplies a printing signal $S_p$ to the voltage applying circuit 32 based on print information $S_c$ supplied from a print demanding electronic device 40 such as a personal computer. The print information $S_c$ contains print data and print control signals. The control circuit 30 includes an input-output interface, CPU, ROM and RAN and controls the operation of the voltage applying circuit 32 according to a stored program. The function of the waiting time checking circuit 34 always will be described later.

Figure 2:
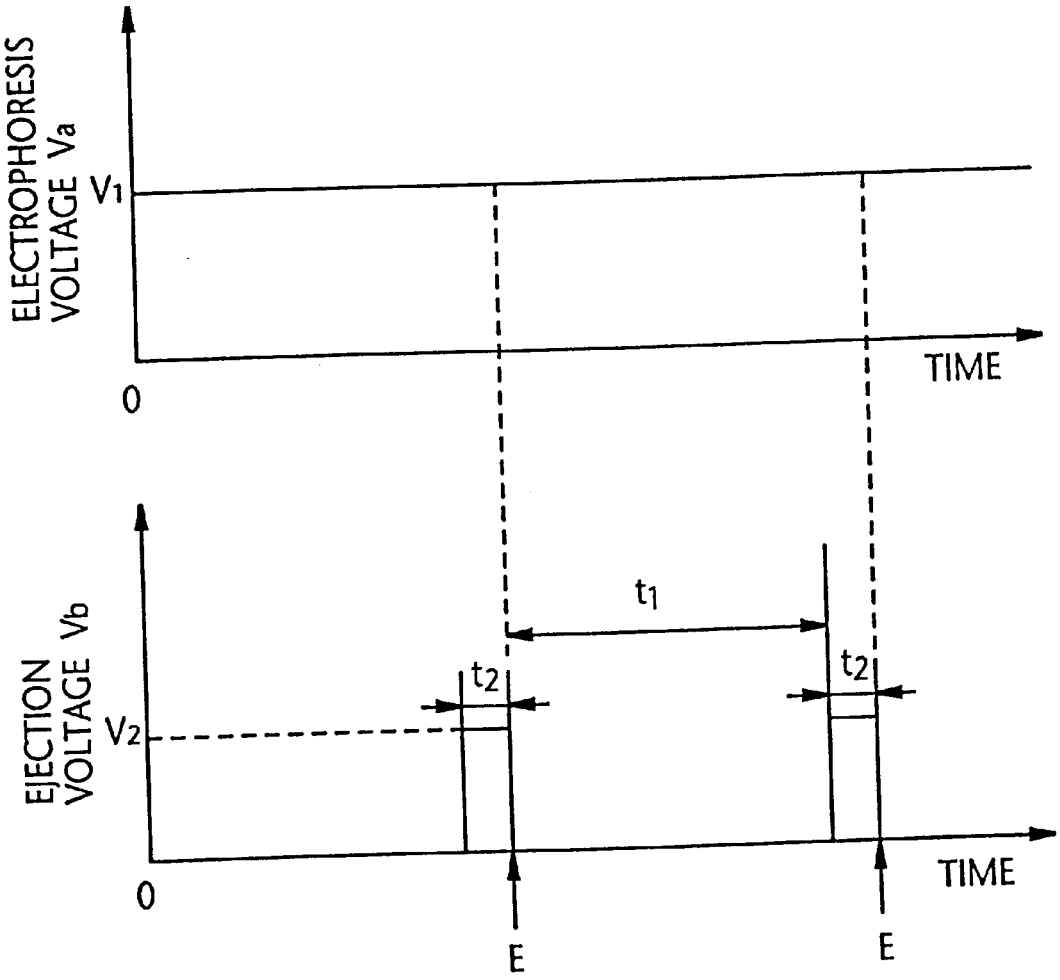
FIG. 2 is a chart showing the fundamental operation of the printer of FIG. 1.

Referring to FIG. 2, the fundamental operation of the printer of FIG. 1 is as follows. As the electrophoresis voltage $V_a$, a constant DC voltage $V_1$ is applied to the electrode 18 to produce an electric field in the ink chamber 18. In the electric field the charged particles 26 of the pigment in the ink 24 migrate at a definite speed toward the ink ejection orifice 20, and after a short period of time the particles 26 concentrate in the vicinity of the orifice 20. Then, as the ejection voltage $V_b$, a DC voltage $V_2$ in the form of a rectangular pulse is applied to the ejection electrode 22 to produce an electric field which acts in the direction of the recording material 44 in the vicinity of the orifice 20. In this case the pulse duration $t_2$ of the voltage $V_2$ ($V_b$) is relatively short. By the action of the Coulomb force attributed to this electric field, an agglomeration 28 of pigment particles 26 concentrated in the vicinity of the orifice 20, together with a small amount of the carrier liquid, is ejected from the orifice 20 toward the recording material 44. The ejected agglomeration 28 of particles 26 impinges on the recording material 44 to form a dot. After the ejection of the agglomeration 28 of pigment particles the ink chamber 18 is replenished with the ink 24, and after the lapse of a period of tine $t_1$, another pulse of voltage $V_2$ is applied to the electrode 22 to eject another agglomeration 28 of particles 26. By repeating this process an image is printed on the recording material 44.

When the pulse duration of the ejection voltage $V_b$ ($V_2$) is considerably longer than $t_2$ in FIG. 2, a few or several agglomerations 28 of pigment particles are ejected one after another at nearly constant time intervals which are nearly equal to $t_2$ in FIG. 2, and on the recording material 44 these agglomerations 28 form a single dot of a relatively large size.

The waiting time checking circuit 34 checks a length of time has elapsed elapsed from the decay of each pulse of the ejection voltage $V_b$ before the rise of the next pulse by comparison with a predetermined length of time stored by the control circuit 30. The apparatus 34 supplies a signal $S_t$ representing the length of the elapsed time or the result of the comparison with the predetermined length of time to the control circuit 30. For this purpose the time checking circuit 34 receives information about the ejection voltage $V_b$ contained in the printing signal $S_p$.

When the length of time represented by the signal $S_t$ is not shorter than a predetermined length of time $T_1$, the control circuit $S_o$ supplies signals $S_i$ and $S_o$ to the voltage applying circuit 32 to vary the electrophoresis voltage $V_a$ so as to prevent unwanted concentration of pigment particles 26 in the vicinity of the orifice 20. For example, the voltage $V_a$ is varied in the following manner.

Figure 3:
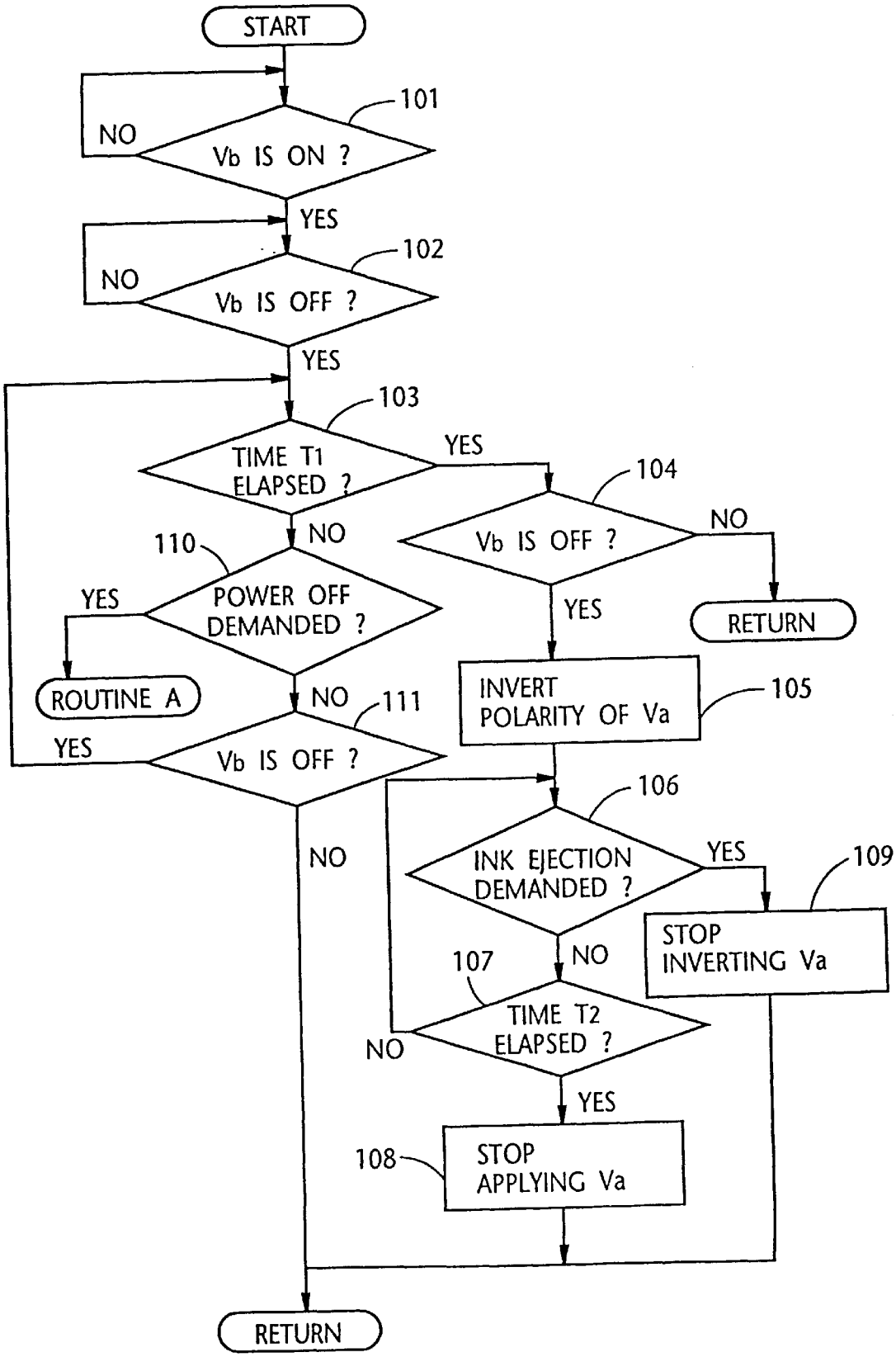
FIGS. 3 and 4 are flow charts of a program for varying a voltage applied to a first electrode in the print head of the printer of FIG. 1.
Figure 5:
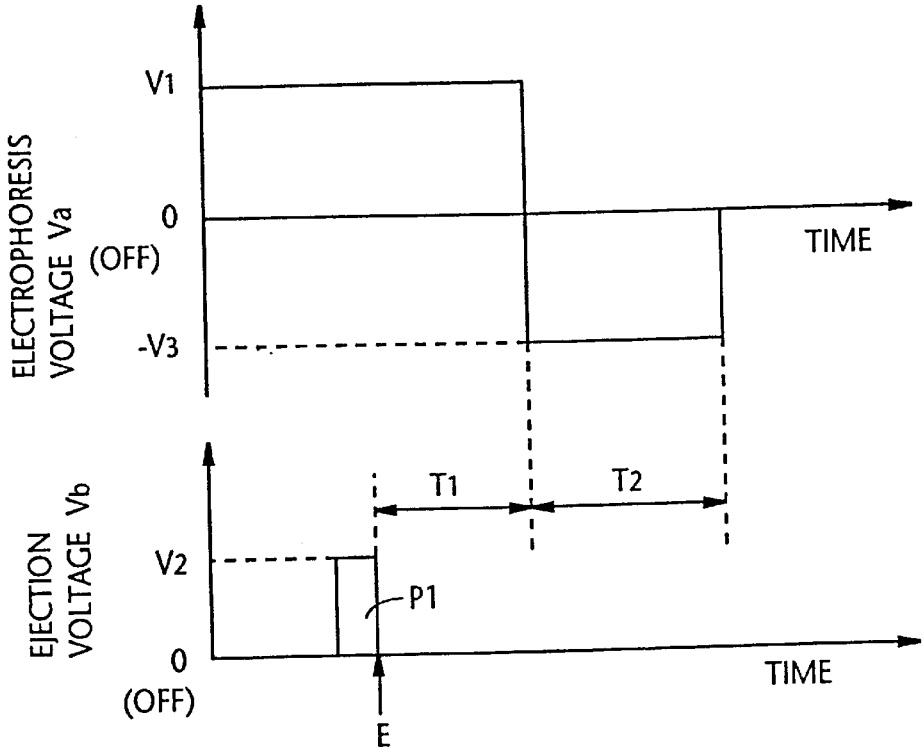
FIGS. 5 and 6 are charts showing variations in the above-mentioned voltage in two different cases, respectively.

Referring to FIG. 5, normally a voltage $V_1$ is applied to the first electrode 18 as the electrophoresis voltage $V_a$, and, at steps 101 to 103 in the flow chart of FIG. 3, the length of time elapsed from the decay of a pulse P1 of the ejection voltage $V_b$ applied to the electrode 22 is always checked and compared with the predetermined length of time $T_1$. If the length of time elapsed before applying a next pulse of the voltage $V_b$ to the electrode 22 reaches $T_1$, the control circuit 30 supplies a voltage inversion signal $S_i$ to the voltage applying circuit 32 to invert the polarity of the voltage $V_a$, at steps 104 and 105 in FIG. 3. Then a voltage $-V_3$ is applied to the electrode 18. The absolute value of $-V_3$ say or may not be equal to that of $V_1$. As the polarity of the electrophoresis voltage $V_a$ is inverted, pigment particles 26 which have been migrating toward the orifice 20 and the particles 26 which have already concentrated in the vicinity of the orifice 20 migrate in the direction away from and opposite to the orifice 20.

Figure 6:
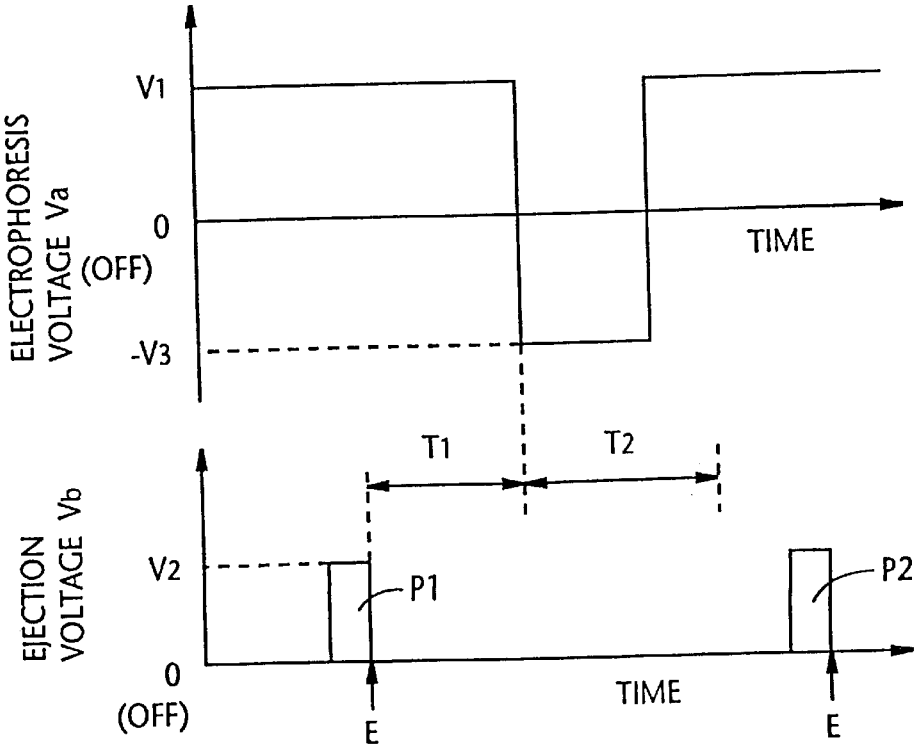

If the ejection of the ink 24, viz. ejection of another agglomeration 28 of pigment particles 26, is not demanded before the lapse of another predetermined length of time $T_2$ from the inversion of the voltage $V_a$ from $V_1$ to $-V_3$, the control circuit 30 outputs a voltage cutoff signal $S_o$ which causes the circuit 32 to cut off application of the voltage $V_a$ (now $-V_3$) to the first electrode 18 (steps 106 to 108 in FIG. 3). Consequently the migration of pigment particles 26 in the ink chamber 16 is interrupted, and the print head 10 of the printer assumes a stand-by state while the pigment particles 28 are not concentrated in the vicinity of the orifice 20. If the ejection of ink is demanded before the lapse of $T_2$, the outputting of the signal $S_i$ is stopped to change the volatge $V_a$ from $-V_3$ to $V_1$ (steps 106, 107, 109), as shown in FIG. 6. Then the pigment particles 26 again migrate toward the orifice 20 and concentrate in the vicinity of the orifice 20. In that state, another pulse P2 of the ejection voltage $V_b$ is applied to the electrode 22.

Figure 4:
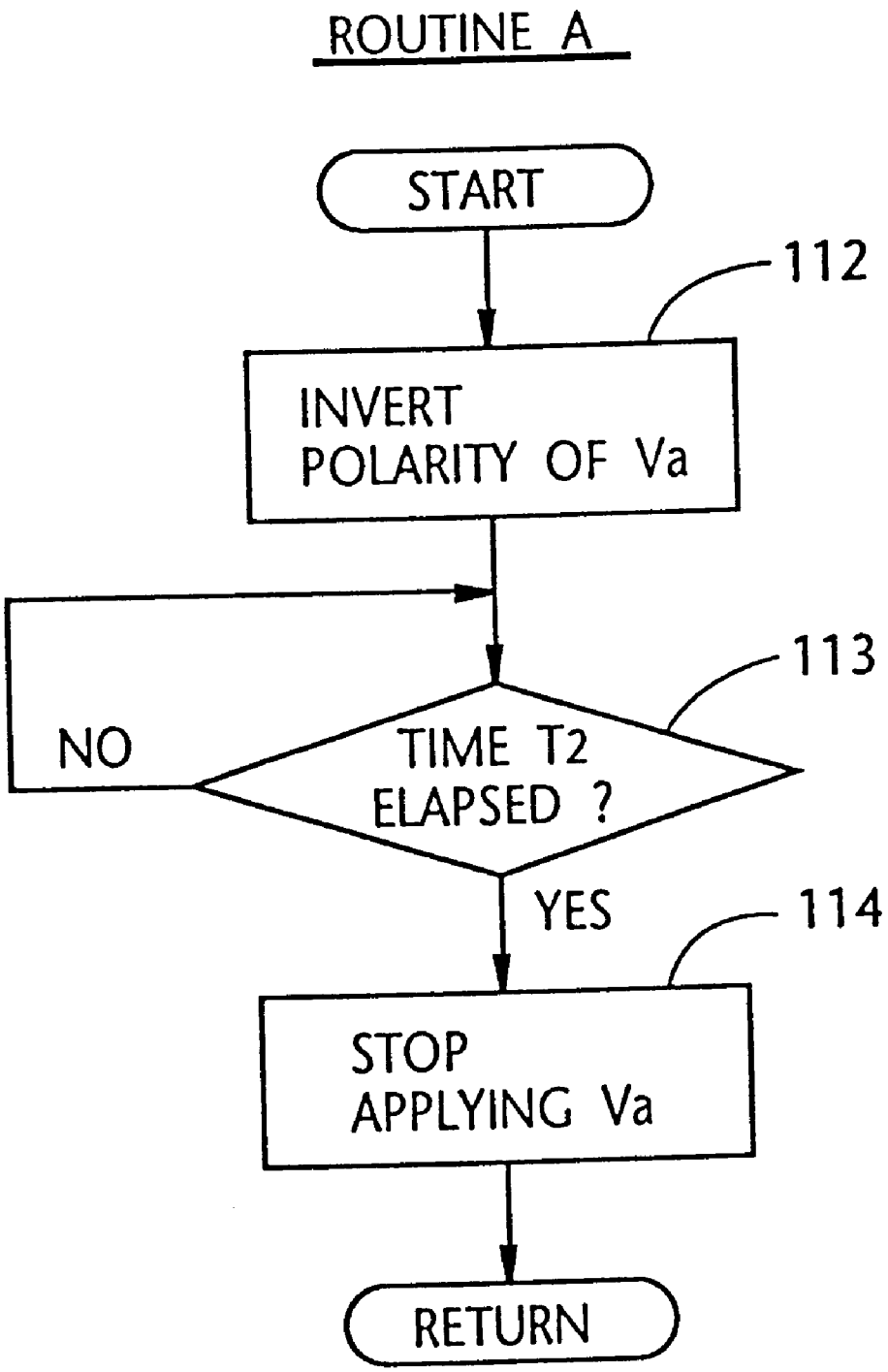

If the control circuit 30 receives a signal to cut off the power supply to the printer before the lapse of $T_1$ from the application of the pulse P1 in FIG. 5 to the electrode 22 (steps 102, 103, 110), the routine A shown in FIG. 4 is executed. At step 112, the control circuit 30 supplies the signal $S_i$ to the circuit 32 to invert the polarity of the voltage $V_a$ from $V_1$ to $-V_3$. So, the pigment particles 26 in the ink chamber 16 migrate in the direction away from and opposite to the orifice 20. At steps 113 and 114, after the lapse of the predetermined length of time $T_2$, the control circuit 30 supplies the signal $S_o$ to the circuit 32 to cut off the application of the voltage $V_a$ to the electrode 18. After that the power supply to the printer is cut off by a power supply control circuit (not shown). By this procedure, the concentration of pigment particles in the vicinity of the orifice 20 is maintained relatively low while the printer is in the inactive state. Therefore, the next operation of the printer does not suffer from clogging of the orifice 20 or unstable ejection of pigment particles.

Figure 7:
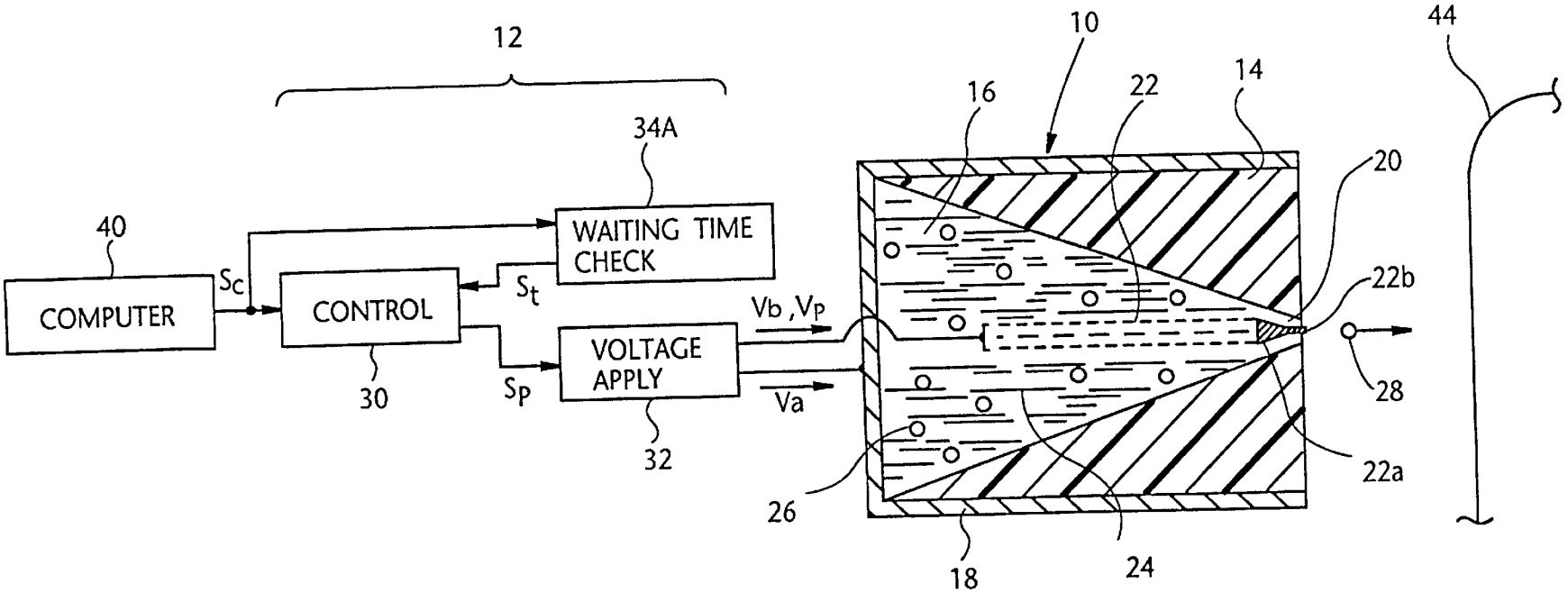
FIG. 7 is a schematic illustration of the principal parts of an ink-jet printer which is another embodiment of the invention.

FIG. 7 shows another embodiment of the invention. The printer of FIG. 7 is almost identical with the printer of FIG. 1, but in the print head in FIG. 7 the tip part 22*a* of the electrode 22 slightly protrudes from the ink chamber 16 through the orifice 20. That is, the tip 22*b* of the electrode 22 is outside of the ink chamber 16 and is close to the center of the orifice 20. In the control part 12 of the printer of FIG. 7, the control circuit 30 and the voltage applying circuit 32 are primarily for applying the electrophoresis voltage $V_a$ to the electrode 18 and the ejection voltage $V_b$ to the electrode 22. The control part 12 includes a waiting time checking circuit 31A, which finds the length of waiting time between the decay of a pulse of the ejection voltage $V_b$ and the rise of a next pulse by using the print information $S_c$ supplied from the computer 40. The length of waiting time refers to the length of time $t_1$ in FIG. 2. The apparatus 34A supplies a signal $S_t$ representing the length of waiting time to the control circuit 30. When the waiting time is not shorter than a predetermined length of time $T_3$, the control circuit 30 modifies the printing signal $S_p$ to cause the circuit 32 to modify the ejection voltage $V_b$ in a predetermined manner. The predetermined length of time $T_3$ may or may not differ from $T_1$ in FIG. 5.

The ejection voltage $V_b$ in the form of a rectangular pulse is applied to the electrode 22 after concentrating the pigment particles 2B in the vicinity of the orifice 20 by the effect of the application of the electrophoresis voltage to the electrode 18. For surely and quickly ejecting an agglomeration 28 of pigment particles 26 by the pulse of the voltage $V_b$, it 18 desirable that a sufficiently large number of pigment particles 26 exist on or close to the surface of the tip part 22*a* of the electrode 22.

Figure 8:
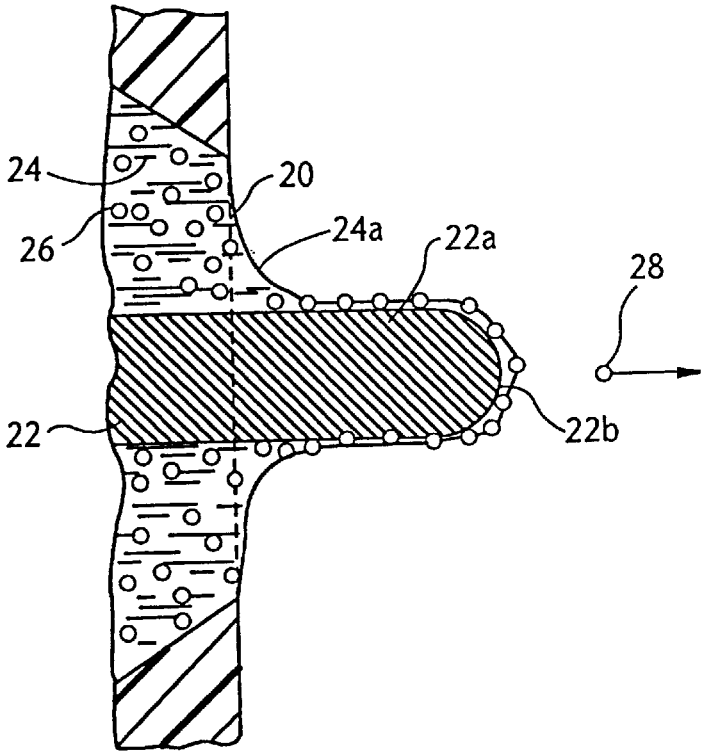
FIG. 8 shows a meniscus of ink developed at an ink ejection orifice of the printer of FIG. 7.

Referring to FIG. 8, as a result of concentration of pigment particles 26 in the vicinity of the orifice 20, a convex maniscus 24*a* of the ink 24 develops at the orifice 20. When the ejection voltage $V_b$ is applied to the electrode 22 to produce an electric field directed toward the recording material 44, an electrostatic force causes further movement of the pigment particles 26 in the vicinity of the electrode 22 in the direction of the electric field. As a result the ink meniscus 24*a* augments to cover the protruding tip part 22*a* of the electrode 22, and the pigment particles 26 concentrate on the tip 22*b* and the nearby surface of the electrode 22. Finally the pigment particles 26 in the vicinity of the electrode tip 22 are ejected toward the recording material 44 as an agglomeration 28 of a large number of particles 26 by overcoming the resistive force attributed to the surface tension and viscosity of the ink 24.

Figure 9:
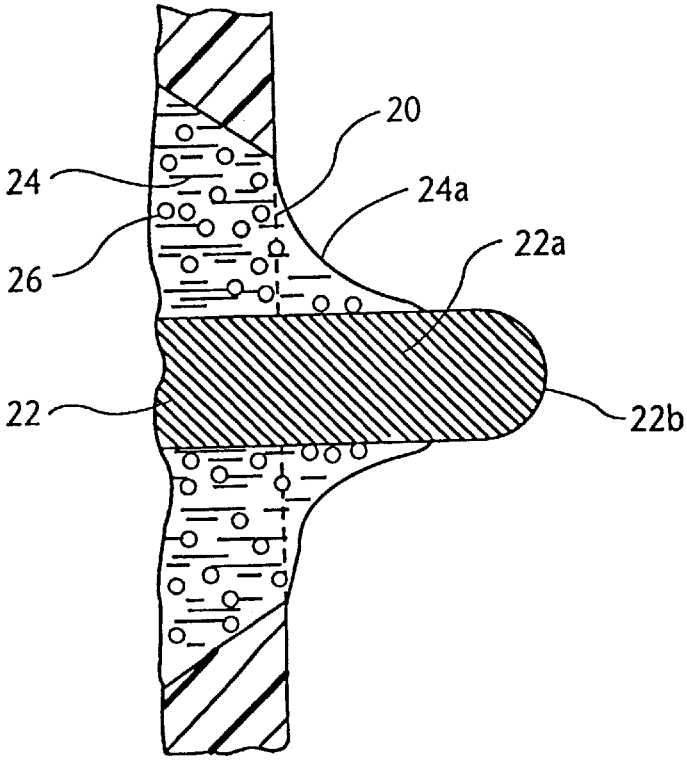
FIG. 9 shows retrogradation of the ink meniscus of FIG. 8.

After the decay of the pulse of the voltage $V_b$ the electrostatic force diminishes, and therefore the ink meniscus 24*a* gradually retrogrades by surface tension of the ink 24. By retrogradation of the meniscus 24*a*, pigment particles 26 are carried away from the tip 22*b* of the electrode 22. However, when the length of the waiting time ($t_1$ in FIG. 2) is relatively short, the retrogradation of the ink meniscus 24*a* is not serious so that the meniscus 24*a* quickly restores the form in FIG. 8 by the application of the next pulse of the voltage $V_b$ to the electrode 22. Referring to FIG. 9, if $t_1$ is relatively long the retrogradation of the meniscus 24*a* proceeds to such an extent that pigment particles 26 scarcely exist on the tip 22*b* and the nearby surface of the electrode 22. Therefore, when the next pulse of the voltage $V_b$ is applied to the electrode 22 it takes a relatively long time to move a large number of pigment particles 26 to the tip 22*b* of the electrode 22, and hence it is likely that the ejection of an agglomeration of pigment particles 26 is delayed or missed.

Figure 10:
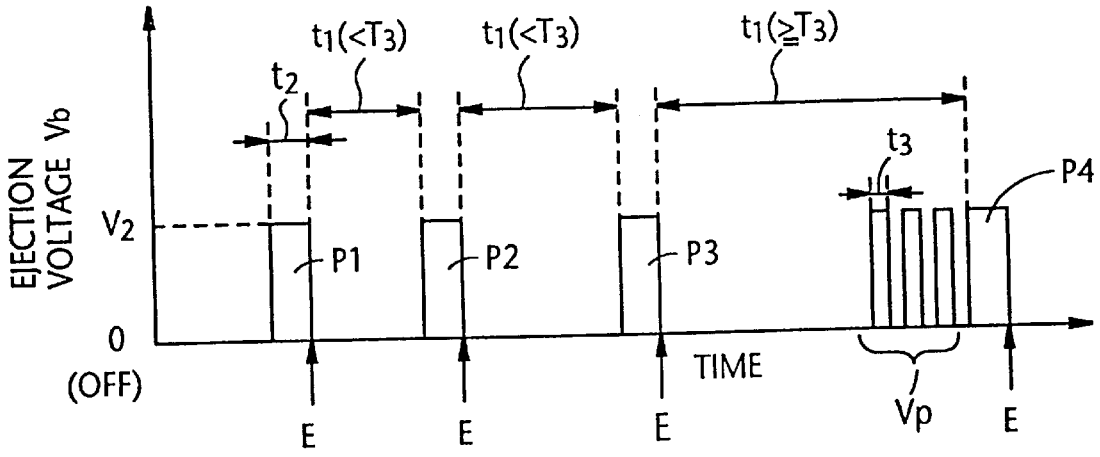
FIG. 10 is a chart showing a temporary modification of a voltage applied to a second electrode in the print head of the printer of FIG. 7.

In the printer of FIG. 7 the ejection voltage $V_b$ is modified, for example, in the manner as shown in FIG. 10 when the waiting time $t_1$ is not shorter than the predetermined length of time $T_3$. In FIG. 10 the waiting time $t_1$ between first and second pulses P1 and P2 is shorter than $T_3$, and $t_1$ between second and third pulses P2 and P3 is also shorter than $T_3$. So, the voltage $V_b$ is not modified for the three pulses P1, P2 and P3. Between the third and fourth pulses P3 and P4, $t_1$ is not shorter than $T_3$. So, the voltage supplying circuit 32 under command of the control circuit 30 applies a pilot voltage $V_p$ to the electrode 22 just before the application of the pulse P4 of the voltage $V_b$. The pilot voltage $V_p$ is for moving pigment particles 26 existing in the vicinity of the orifice 20 toward the tip 22*b* of the electrode 22 without causing ejection of the particles 26. In this example, the pilot voltage $V_p$ is a pulse train consisting of three rectangular pulses each of which has an amplitude of $V_2$ (the same as the amplitude of the pulses P1, P2, P3, P4) and a duration of $t_3$ which is shorter than the duration $t_2$ of the pulses P1, $P_2$, $P_3$, $P_4$. By the effect of the pilot voltage $V_p$ the pigment particles 26 are concentrated on the tip 22*b* and the nearby surface of the electrode 22. Therefore, when the pulse $P_4$ of the ejection voltage $V_b$ is applied to the electrode 22, the ejection of an agglomeration 28 of pigment particles is surely accomplished without delay.

It is possible to vary the amplitude ($V_2$) of the pulse $P_4$ instead of applying the pilot voltage $V_p$ to the electrode 22.

The above-described modification of the ejection voltage $V_b$ can be made together with or independently of the precedently described modification of the electrophoresis voltage $V_a$.

What is claimed is:

1. An ink-jet printer which uses an ink containing fine solid particles of a coloring material suspended in a carrier liquid, comprising:

a print head comprising (i) an ink chamber to be filled with said ink, (ii) an ink ejection orifice located at one end of said ink chamber, (iii) a first electrode surrounding said ink chamber to produce an electric field in said ink chamber such that by electrophoresis induced by said electric field, said particles in said ink in said ink chamber are concentrated in the vicinity of said orifice, and (iv) a second electrode which is disposed in said ink chamber and has a tip positioned close to said orifice to produce another electric field to eject at least one agglomeration of said particles together with an amount of said carrier liquid from said orifice; and control means for controlling said print head comprising:

first means for applying a first DC voltage to said first electrode and periodically applying a second DC voltage as a pulse to said second electrode based on externally supplied print information, second means for checking an elapsed length of time which has elapsed from a decay of the pulse of said second DC voltage before a rise of a next pulse of said second DC voltage, third means for inverting a polarity of said first DC voltage, and fourth means for storing a first predetermined length of time which is arbitrarily chosen;

wherein said second means compares said elapsed length of time with said first predetermined length of time, and when said elapsed length of time checked by said second means is the same or greater than said first predetermined length of time, said polarity of said first DC voltage is inverted.

2. An ink-jet printer according to claim 1, wherein said third means suspends the application of said first DC voltage to said first electrode after the lapse of a second predetermined length of time from the inversion of said polarity.

3. An ink-jet printer according to claim 2, wherein said third means returns a inverted polarity of said first DC voltage to the polarity before the lapse of said a second predetermined length of time from the inversion of said polarity if said print information implies applying a next pulse of said second DC voltage to said second electrode.

4. An inkjet printer according to claim 1, wherein said third means inverts the polarity of said first DC voltage while said elapsed length of time is shorter than said first predetermined length of time if said print information provides that a power supply to the printer is shut off.

5. An ink-jet printer according to claim 4, wherein said first means discontinues the application of said first DC voltage to said first electrode after the lapse of a second predetermined length of time after the third means inverts inverting said polarity.

6. An ink-jet printer according to claim 1, wherein said ink chamber becomes gradually narrower in cross-sectional area from an end opposite to said one end toward said one end.

7. An ink-jet printer according to claim 1, wherein the tip of said second electrode slightly protrudes from said ink chamber through said orifice.

8. An ink-jet printer which uses an ink containing fine solid particles of a coloring material suspended in a carrier liquid, comprising:

a print head comprising (i) an ink chamber to be filled with said ink, (ii) an ink ejection orifice located at one end of said ink chamber, (iii) a first electrode surrounding said ink chamber to produce an electric field in said ink chamber such that by electrophoresis induced by said electric field, said particles in said ink in said ink chamber are concentrated in the vicinity of said orifice, and (iv) a second electrode which is disposed in said ink chamber and has a tip positioned close to said orifice to produce another electric field to eject at least one agglomeration of said particles together with an amount of said carrier liquid from said orifice; and control means for controlling said print head comprising:

first means for applying a first DC voltage to said first electrode and periodically applying a second DC voltage as a pulse to said second electrode based on externally supplied print information, second means for checking an elapsed length of time which has elapsed from a decay of the pulse of said second DC voltage before the rise of a next pulse of said second DC voltage, and third means for applying a pilot DC voltage to said second electrode before applying the next pulse of said second DC voltage to said second electrode, fourth means for storing a predetermined length of time which is arbitrarily chosen;

wherein said second means compares said elapsed length of time with said predetermined length of time, and when said elapsed length of time checked by said second means is the same or greater than said predetermined length of time, said pilot DC voltage is effective for moving the particles of the coloring material existing in the vicinity of said orifice toward the tip of said second electrode and ineffective for ejecting said particles from said orifice.

9. An ink-jet printer according to claim 8, wherein said pilot DC voltage is a group of rectangular pulses each of said rectangular pulses is shorter in pulse duration than each said pulse of said second DC voltage.

10. An ink-jet printer according to claim 8, wherein the tip of said second electrode slightly protrudes from said ink chamber through said orifice.

11. An ink-jet printer according to claim 8, wherein said ink chamber becomes gradually narrower in cross-sectional area from an end opposite to said one end toward said one end.

* * * * *

UNITED STATES PATENT AND TRADEMARK OFFICE

CERTIFICATE OF CORRECTION

PATENT NO.: 6,022,097
DATED: February 08, 2000
INVENTOR(S): Hitoshi MINEMOTO; Yoshihiro HAGIWARA; Ryousuke UEMATSU; Junichi SUETSUGU; Kazuo SHIMA It is certified that error(s) appears in the above-identified patent and that said Letters Patent is hereby corrected as shown below:

Column 3, line 35 delete "sane" insert --same--
Column 4, line 6 delete "18" insert --16--
line 37 delete "circuit" insert --apparatus--
line 44 delete "circuit" insert --apparatus--
line 65 delete "say" insert --may--
Column 5, line 53 delete "31A" insert--34A--
line 67 delete "2B" insert --26--
Column 6, line 13 delete "18" insert --is--

Signed and Sealed this

Third Day of April, 2001

*Attest:*

Nicholas P. Godici

NICHOLAS P. GODICI

*Attesting Officer*

*Acting Director of the United States Patent and Trademark Office*